US005205800A

United States Patent [19]

Grant

[11] Patent Number: 5,205,800

[45] Date of Patent: Apr. 27, 1993

[54] ALL TERRAIN TREADMILL

[76] Inventor: Fred W. Grant, 3177 Terrace Ct., Apt. H, Norcross, Ga. 30092

[21] Appl. No.: 792,367

[22] Filed: Nov. 15, 1991

[51] Int. Cl.[5] ..... A63B 22/02

[52] U.S. Cl. ..... 482/54; 482/902; 198/861.5

[58] Field of Search ..... 482/54, 902, 53, 52; 198/861.5, 592

[56] References Cited

U.S. PATENT DOCUMENTS

| | | | |
|---|---|---|---|
| 759,296 | 5/1904 | Morairty . | |
| 3,518,985 | 7/1970 | Quinton . | |
| 3,592,466 | 7/1971 | Parsons | 482/53 |
| 3,637,206 | 1/1972 | Chickering, III . | |
| 3,643,943 | 2/1972 | Erwin, Jr. et al. . | |
| 3,689,066 | 9/1972 | Hagen . | |
| 3,826,491 | 7/1974 | Elder | 482/54 |
| 4,643,418 | 2/1987 | Bart | 482/902 |
| 4,735,410 | 4/1988 | Nobuta | 482/902 |
| 4,776,582 | 10/1988 | Ramhorst . | |
| 4,913,396 | 4/1990 | Dalebout et al. | 482/54 |
| 4,976,435 | 12/1990 | Shatford et al. | 482/902 |
| 5,029,801 | 7/1991 | Dalebout et al. | 482/54 |
| 5,062,632 | 11/1991 | Dalebout et al. | 482/54 |

*Primary Examiner*—Richard J. Apley
*Assistant Examiner*—Lynne A. Reichard
*Attorney, Agent, or Firm*—Hopkins & Thomas

[57] ABSTRACT

A exercising treadmill (10) having a running platform (28) over which a treadmill belt (30) advances for walking or running thereon including a cam mechanism for adjusting the slope of the running platform (28) and an electric motor (32) for adjusting the driven speed of the treadmill belt. The exercising treadmill (10) also includes a video monitor (65) and a video tape player (66) for displaying an image of an exercising environment. Means are provided for controlling the speed of the treadmill belt (30) and slope of the running surface (28) and for synchronizing said speed and slope of the belt (30) with the speed at which the terrain of the displayed image moves and the slope of the terrain of the displayed image. Thus, the machine can be preprogrammed and fed into the control system and a video image of a race course, for example, can be displayed on the video screen synchronized with the control of the grade of the platform.

6 Claims, 2 Drawing Sheets

ALL TERRAIN TREADMILL

FIELD OF THE INVENTION

The present invention relates to treadmills of the type used by doctors and hospitals for testing the cardiac and aerobic conditioning of patients or for rehabilitation of such patients. Also, treadmills of this type are often used at health clubs by club members for aerobic workouts.

BACKGROUND OF THE INVENTION

Heretofore, treadmills have been designed with either an exercising platform having an inclined tread surface or a horizontal tread surface upon which a person walks or runs in place. While such treadmills provide users with a good overall workout, they limit the accuracy of cardiac and aerobic tests and poorly simulate actual walking or running conditions. Furthermore, a treadmill with an inclined grade can often overstress certain of the leg muscles and understress various other leg muscles. In order to alleviate the problems, some treadmills have been designed so that the grade of their exercising platforms can be continually adjusted from a level position to a position with an inclined grade in order that actual walking or running conditions may be better simulated, but none of these known prior art machines provides a successful adjustment feature for the tread surface that simulates conditions of walking or running downhill.

Furthermore, many people consider traditional treadmills to be an unexciting, tedious, and even boring way to exercise. Consequently, treadmills with a variety of features have been introduced in order to make exercising more interesting, such as treadmills with an added television monitor, added headphone set, and/or a heart monitoring meter. However, these features are simply add-on features to the basic treadmill and still give the user the tiring and sometimes monotonous feeling that he or she is still simply walking or running on a treadmill. Even treadmills with computerized exercise programs for automatically varying the grade and speed of the exercising platform have only a limited ability to overcome the inherent monotony of the treadmill, and the exercising platforms of these treadmills usually can only be positioned with their tread surfaces in a horizontal or in an upwardly inclined position.

SUMMARY OF THE INVENTION

It is an object of the present invention to simulate actual uphill and downhill walking and running conditions on a treadmill and thereby to make treadmills more versatile and hence more interesting to use.

It is a further object of the present invention to simulate a realistic exercising environment and thereby to make treadmills more interesting to use.

Briefly described, the present invention, in a preferred embodiment thereof, is a treadmill with an exercising platform that can be adjusted to have an inclining, declining, or horizontal grade whereby the conditions of walking or running uphill, downhill, and on a flat terrain can be simulated. The treadmill also includes a video monitor for playing video footage of a course of a road race, or other outdoor exercising environment, and a means for synchronizing the grade of the platform with the video wherein the grade of the running platform is automatically adjusted to correspond with the continuously changing grade of the portion of the course shown on the video monitor.

The arrangement of the preferred embodiment comprises a treadmill having variable drive means for changing the speed thereof and, in accordance with a feature of the invention, means for altering the slope of the exercising platform of the treadmill to produce either an inclining or declining, as well as a horizontal, moving tread surface. A video monitor adjacent the treadmill is adapted to display, for example, a road racing course as depicted on a video tape, for example. Programmable control means, such as a simple computer, is programmed to vary the speed and slope of the treadmill to correspond to changes in speed and slope of the course as present on the video tape, and hence the monitor. The computer receives a start signal from the video tape to start its program in synchronization with the changing scene on the video monitor, and the program causes it to vary the speed of the variable drive means and the slope of the treadmill through the slope adjusting means as the speeds and slopes vary in the video display.

With the present invention, the user of the treadmill is better able to test his or her cardiac and aerobic conditioning because he or she can experience the simulated conditions of walking or running both up and down hills, and the user can observe a video image which enhances the sensation of walking or running by the relationship between the position and speed of the treadmill and the observed image, to the point that the user may actually have the illusion that he or she is out-of-doors exercising. In addition, with the present invention, the user is able to get an approximate indication of how well he or she would perform in the particular road race shown on the video monitor.

The various objects, features and advantages of the present invention will become apparent from the following detailed description read in conjunction with the accompanying drawings.

DETAILED DESCRIPTION

Figure 1:
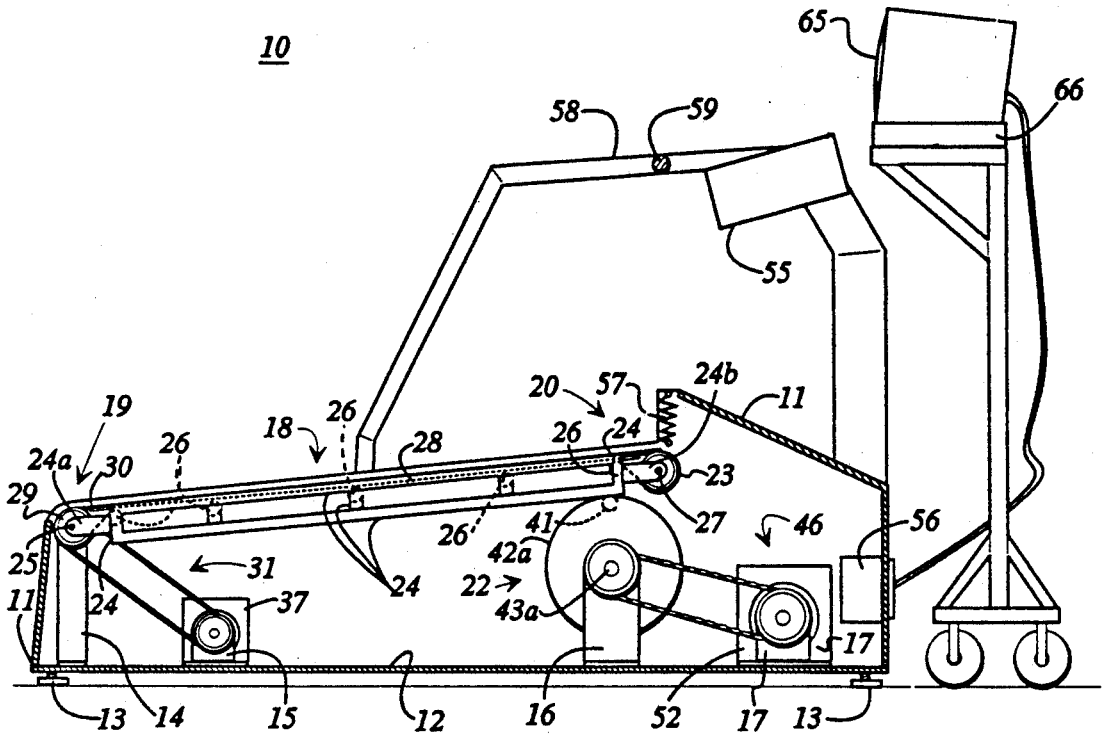
FIG. 1 is a side elevation view of the treadmill of the invention with a side panel removed, illustrating the interior of the treadmill including the platform running surface, the belt drive means for the platform running surface, and a platform tilt cam mechanism for adjusting the grade of the platform. Also shown is a video monitor, a video tape player, and control means.

Referring now to the drawings wherein like numerals represent like elements throughout the several views, FIG. 1 shows an all terrain treadmill 10 that embodies the principles of the present invention in a preferred form. The treadmill 10 comprises a frame 11 which includes a rectangular support base 12 supported by legs 13 and has vertical support members 14, 15, 16, and 17, each comprising four support bars, extending upwardly therefrom for supporting various components of the treadmill. A treadmill belt platform assembly 18, having a pivoting end 19 and a height adjustable end 20, is pivotally mounted at pivoting end 19 between the top portions of support members 14, as shown in FIG. 3, and supported at adjustable end 20 by a cam mechanism 22, as seen in FIG. 4, which functions as a means for adjusting the height of end 20 relative to end 19 and base 12, and hence the grade or incline of the platform assembly 18.

As shown in FIG. 1, platform assembly 18 comprises a rectangular frame 24 which supports a flat running support surface 28 fastened at its lateral side edges to the side beams of frame 24 and defining an upwardly facing surface for supporting the upper flight of treadmill belt 30 and a person exercising thereon. Belt platform assembly 18 also comprises an end roller 23 which is journaled to, and extends between, a pair of extension members **24*b* on frame 24, a plurality of treadmill belt support rollers 26 journaled to, and extending between, the side beams of frame 24 at longitudinally spaced intervals along the length of the frame, and treadmill belt drive roller 29 journaled to, and extending between, vertically extending support members 14. Drive roller 29 is mounted on an axle 25 which extends between supports 14 and is free to rotate with respect thereto. Axle 25 also supports the pivoting end 19 of the platform assembly 18 at extension members 24*a* of the frame 24 at points along the axle, such points being on an reference axis lying in a first, or horizontal plane above and below which the adjustable end of the platform assembly 18 pivots thereby changing the grade of the running surface 28**. Reference to such first plane will be made hereinafter.

Figure 2:
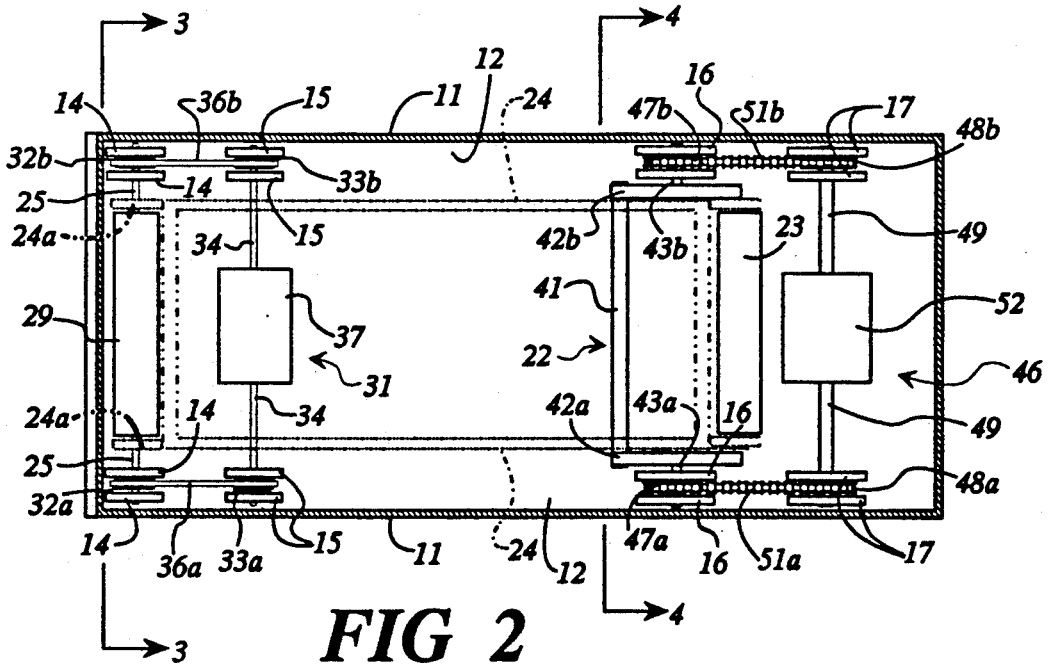
FIG. 2 is a plan view of the treadmill with the exercising platform assembly of the treadmill removed, illustrating the belt drive means and the platform tilt cam mechanism.
Figure 3:
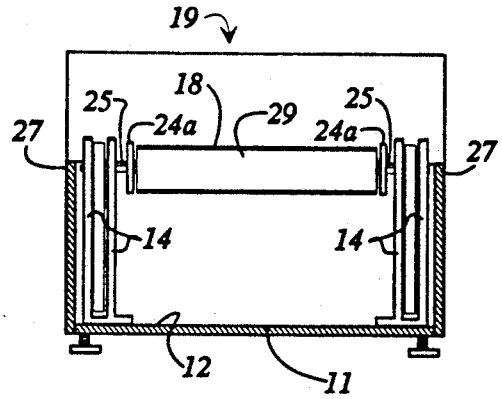
FIG. 3 is an end elevation view, taken along lines 3—3 of FIG. 2, showing a cross-section of the driven end of the platform and the support frame for this end.
Figure 4:
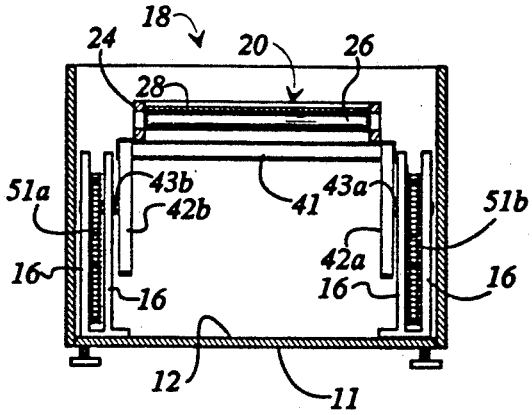
FIG. 4 is an end elevation view, taken along lines 4—4 of FIG. 2, showing a cross-section of the cam mechanism.

FIG. 3 illustrates the manner in which drive roller 29 is journaled to support members 14 and supports extension members **24*a* of frame 24. The four vertically extending support members 14 rotatably support axle 25 of drive roller 29 at two points at both ends of roller 29, and between each of these support points is coupled belt drive means 31, as best seen in FIG. 2 and as will be discussed hereinafter. Alternative arrangements for pivoting platform assembly 18, and thereby adjusting its grade, are feasible, such as, for example, pivotally supporting assembly 18** at some point between the ends thereof and adjusting the height of one of the ends of the assembly. However, the arrangement of the aforementioned preferred embodiment performs satisfactorily in operation.

As seen in FIG. 1, an endless treadmill belt 30 extends about displaceable roller 23 and drive roller 29 and along a path which defines a lower flight over the upper surface of the treadmill belt support rollers 26 and an upper flight over the surface of running support surface 28. Belt 30 is adapted to move rearwardly across running support surface 28 toward pivoting end 19 when drive roller 29 is rotated by belt drive means 31.

Belt drive means 31 is adapted to rotate roller 29, and hence endless treadmill belt 30 along platform assembly 18 As shown in FIG. 2, the drive means 31 comprises driven sheaves **32*a* and 32*b* mounted to roller 29 between support members 14, drive sheaves 33*a* and 33*b* mounted to drive axle 34 which is rotatably supported by vertically extending support members 15 of frame 11, V-belts 36*a* and 36*b* adapted to rotate around sheaves 32 and 33, and variable speed drive motor 37 for rotating drive axle 34. It should be understood that many types of conventional drive means that are known to those skilled in the art are suitable for variably controlling the rotation of endless belt 30** and are within the scope of the present invention.

Cam mechanism 22, as best seen in FIG. 4, is adapted to raise and lower height adjustable end 20 of platform assembly 18 with respect to the previously mentioned first plane along which the reference axis of axle 25 lies. Cam mechanism 22 comprises a cam lift arm 41 rotatably mounted to, and extending between, a pair of cam wheels **42*a* and 42*b* at the outer radial edges thereof, and cam axles 43*a* and 43*b* fixedly mounted at one of their ends to cam wheels 42*a* and 42*b* and rotatably mounted to vertical support members 16 of frame 11 at their other ends. Cam axles 43*a* and 43*b* are adapted to rotate wheels 42*a* and 42*b*, and hence cam lift arm 41. The bottom structural beams of frame 24 at adjustable end 20 of assembly 18 are supported by cam lift arm 41 and move up and down as wheels 42*a* and 42*b* are rotated, thus, causing the platform assembly 18 to pivot about pivoting end 19**.

Figure 5A:
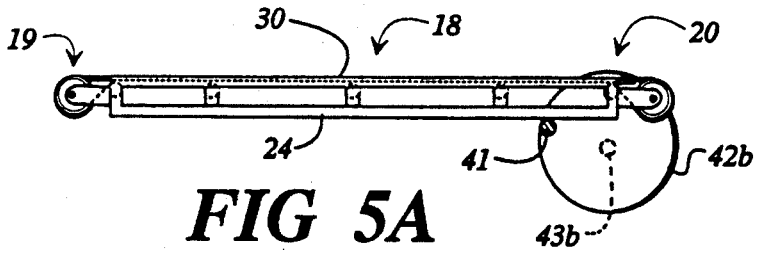
FIGS. 5A through 5C are diagrammatic views of the platform assembly and cam mechanism illustrating the angular relationship between the two during operation.
Figure 5B:
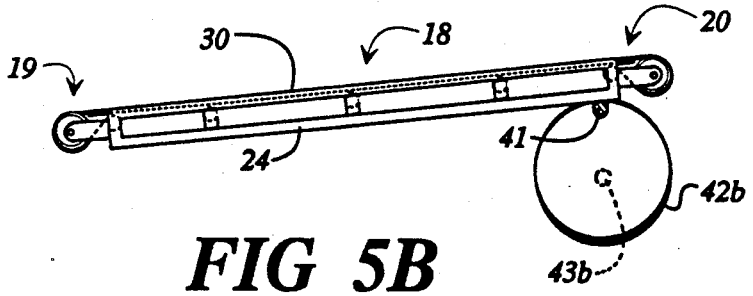
Figure 5C:
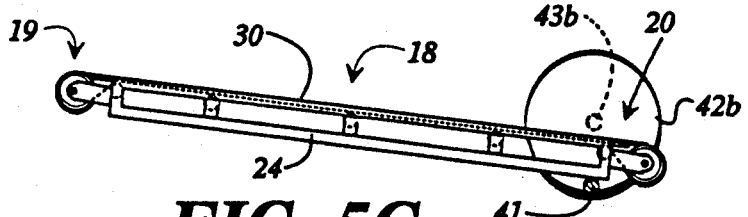

As depicted in FIGS. 5A through 5C, when cam wheels **42*a* and 42*b* rotate in unison (only wheel 42*b* shown), cam lift arm 41 rotates about the axis of cam axles 43*a* and 43*b* (only axle 43*b* shown), whereby cam lift arm 41 moves up (FIG. 5B) and down (FIG. 5C) and in turn raises and lowers adjustable end 20 of platform assembly 18 through a range of positions extending from above the first plane to below the first plane, whereby the running support surface 28 is moved through a range of slopes extending from an inclined slope to a declined slope. Alternative designs for raising and lowering one end of platform 18** could be used, such as a pneumatically controlled piston/cylinder arrangement or a gear linkage arrangement coupled to an electric motor, such arrangements being known to those skilled in the art.

As shown in FIG. 2, cam mechanism 22 also includes a cam drive means 46 for rotating cam wheels **42*a* and 42*b*, and which, in a preferred embodiment, comprises driven sheaves 47*a* and 47*b* fixedly mounted on cam axles 43*a* and 43*b* respectively, drive sheaves 48*a* and 48*b*, mounted on a drive axle 49 which is rotatably supported by vertical support members 17 of frame 11, V-belts 51*a* and 51*b* extending between the drive and driven sheaves 48*a*, 47*a* and 48*b*, 47*b*, respectively, and an electric drive step motor 52 for rotating drive axle 49, and hence drive sheaves 48*a* and 48*b*, V-belts 51, driven sheaves 47 and cam wheels 42**.

A control panel 55 is adapted to allow the user of treadmill 10 to select the exercise program of his or her choosing, and control means 56 is adapted to receive output signals from control panel 55 and to control motors 37 and 52 accordingly. For example, control panel 55 may include an on/off switch and a speed switch for controlling the speed of the treadmill belt and may be designed to allow the user to choose a "flat" course or an "all terrain" course whereby control means 56 is adapted either to position cam lift arm 41 so that platform assembly 18 is positioned horizontally, as shown in FIG. 5A, or rotate cam lift arm 41 so that platform assembly 18 alternates from a horizontal position to an inclined position to a horizontal position to a declined position, and so on, as shown in FIGS. 5B and 5C.

As shown in FIG. 1, treadmill 10 also includes an accordion pleated curtain screen 57 for covering the opening between adjustable end 20 of platform assembly 18 and frame 11, which opening varies as cam mechanism 22 moves adjustable end 20 up and down. Treadmill 10 also includes a pair of guard rails 58 (only one shown) disposed laterally at the sides of the treadmill and a hand bar 59 extending between the guard rails for assisting the user in maintaining his or her balance during operation.

The present invention also comprises, in addition to the features discussed hereinbefore, a display means, such as, for example, video monitor 65 and a tape player 66, wherein tape player 66 is adapted to play a video tape and monitor 65 is adapted to receive the video signal from the tape and display a visual image. As the user of the treadmill is walking or running on platform assembly 18, he or she can view, for example, the course of a popular road race on monitor 65. Also, the control means 56 is adapted to receive, for example, a tape or disc or other suitable program means known to those skilled in the art, preprogrammed in conjunction with the video tape of the display means whereby control means 56 receives signals from the tape or disc and adjusts the speed of treadmill belt 30 and grade of platform assembly 18 in accordance with the visual image displayed on monitor 65. Control means 56 is also adapted to synchronize the pre-programmed tape or disc with the video tape player 66 by receiving a timing signal from the video tape player 66 whereby control means 56 starts playing the pre-programmed tape when this timing signal is received. The video tape of the road race may be produced by moving a camera along the course of the road race at a predetermined speed, and the preprogrammed tape or disc can thereafter be programmed with the information of the speed of the camera and the progressively changing grade of the road race course. In operation, the user will see the course of the road race while running on running surface 28 with endless belt 30 moving at a speed in correspondence with the visual image and with platform assembly 18 tilted to the corresponding grade of the portion of the course shown on the monitor. The timing signal received from tape player 66 serves to ensure that the grade changes of platform assembly 18 correspond to the grade changes of the course shown on the monitor. Other scenes can be filmed and programmed onto the tapes or discs, such as mountain and beach scenes, and the speed at which the scenes are filmed can be varied, with the pre-programmed tape programmed accordingly, for allowing the user to experience varying speed conditions. Also, tape player 66 may include a means (not shown) for connecting a head set to control panel 55 whereby the user can listen to an audio signal from the tape player. For clarity, the various connecting wires among the several parts have not been shown.

With the present invention, walkers and runners can select the course they would like to train for from, for example, a health center's audio/video library of exercise courses; doctors can make audio/video exercise programs to fit the exact needs of heart patients; and trainers can make audio/video programs to help in the rehabilitation of injured athletes and other patients.

It will be understood that the foregoing relates only to a preferred embodiment of the present invention, and that numerous changes and modifications may be made therein without departing from the spirit and scope of the invention as set forth in the following claims.

What is claimed is:

1. An exercise apparatus comprising:

a frame including a base member;

first means defining a longitudinally extending tread surface, said first means having first and second ends with said first end being pivotally mounted to said frame along an axis lying in a first plane and said second end being movable with respect to said frame;

a longitudinally movable endless belt having an upper and lower flight, said upper flight being supported on said surface;

drive means on said frame for moving said endless belt longitudinally along said surface; and adjusting means on said base member for moving said second end of said first means through a range of positions extending from above said first plane to below said first plane whereby said thread surface is moved through a range extending from an inclined slope to a declined slope, said adjusting means comprising a rotatable support member mounted on said base member for supporting said second end.

2. An exercise apparatus according to claim 1 wherein said drive means for moving said endless belt comprises first and second rollers disposed at opposite ends of said tread surface, said belt being adapted to move around said rollers, and a drive motor for rotating said first roller.

3. An exercise apparatus according to claim 1 and further comprising control means for controlling the speed of rotation of said drive means and controlling the position of said adjusting means.

4. An exercise apparatus according to claim 3 and further comprising display means for displaying a moving picture of a varying running environment, and means for synchronizing the speed of said endless belt and slope of said tread surface with the speed at which the image shown on said display means appears to move and with the slope of the terrain of the image shown on said display means.

5. An exercise apparatus according to claim 4 wherein said control means is adapted to receive a preprogrammed means for controlling said drive means and said adjusting means, the pre-programmed means being programmed with information regarding the speed at which the image shown on said display means appears to move and the variable slope of the terrain of the image shown on said display means.

6. An exercise apparatus comprising:

a frame including a base member;

means defining a longitudinally extending tread surface, said tread surface having first and second ends with said means being pivotally mounted to said frame along an axis lying in a first plane;

a longitudinally movable endless belt having an upper and lower flight, said upper flight being supported on said surface;

drive means on said frame for moving said endless belt longitudinally along said surface; and adjusting means on said base member for moving one of said ends of said tread surface through a range of positions extending from above said first plane to below said first plane whereby said tread surface is moved through a range extending from an inclined slope to a declined slope, said adjusting means comprising a cam wheel rotatably supported by said base member and having an axis of rotation, a cam lift arm rotatably mounted on said cam wheel and extending substantially parallel to said axis of rotation and spaced therefrom, and a drive means for rotating said wheel, whereby said tread surface is inclined from said first end to said second end when said cam lift arm is at its farthest position from said base member and said surface is declined from said first end to said second end when said cam lift arm is at its closest position to said base member.

* * * * *